United States Patent [19]

Duchateau

[11] 4,076,224

[45] Feb. 28, 1978

[54] TUNDISHES

[75] Inventor: Jean Louis Duchateau, Jouy-en-Josas, France

[73] Assignee: Foseco Trading A.G., Chur, Switzerland

[21] Appl. No.: 784,793

[22] Filed: Apr. 5, 1977

[30] Foreign Application Priority Data

Apr. 7, 1976 United Kingdom ..... 14195/76

[51] Int. Cl.[2] ..... C21C 7/00

[52] U.S. Cl. ..... 266/275; 266/280

[58] Field of Search ..... 266/275, 280–286; 164/281, 412

[56] References Cited

U.S. PATENT DOCUMENTS 4,012,029 3/1977 Seguin et al. ..... 266/275

*Primary Examiner*—Gerald A. Dost

*Attorney, Agent, or Firm*—Cushman, Darby & Cushman

[57] ABSTRACT

A tundish is described in which a refractory lined metal casing has an inner expendable lining. In the impact area, there is a pad of erosion resistant and sacrificial material. According to the invention, a body of refractory material of high thermal conductivity is located below the pad to conduct heat away therefrom.

6 Claims, 3 Drawing Figures

TUNDISHES

Figure 1:
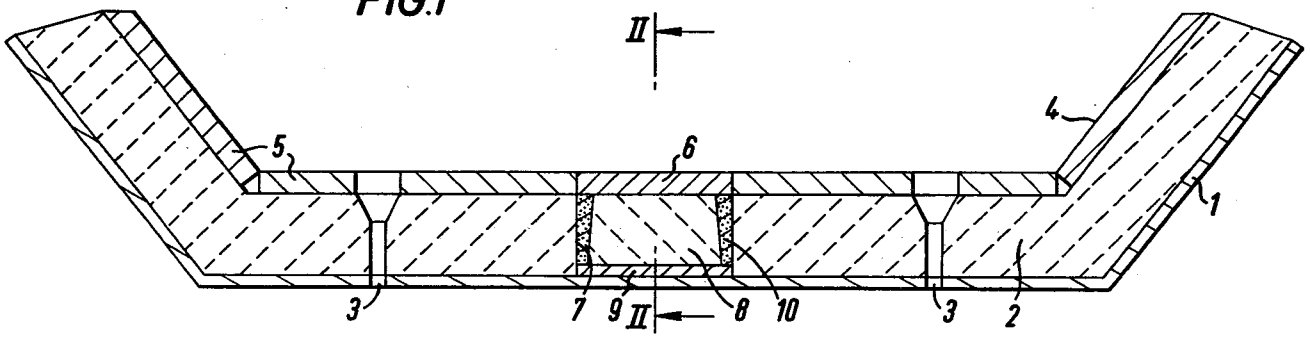

This invention relates to tundishes of the type used in continuous casting of steel and for convenience will be described with reference to a tundish of the type described and claimed in our British patent specification No. 1,364,655. The tundish there described comprises an outer metal casing, a permanent lining of refractory material adjacent the casing and an inner expendable lining made up of a set of slabs of heat-insulating refractory material, the impact area of the tundish being protected by highly erosion resistant material or sacrificial material. In use, the permanent lining is shielded by the expendable lining so that the permanent lining can last for e.g. 100 casting cycles. In addition, by the use of the inner expendable lining the need to preheat the whole of the tundish before each casting cycle is avoided and the preheating can be confined to the outlet nozzle only.

British patent specification 1469513 describes a modified tundish in which the expendable lining is separated from the permanent lining by a layer of essentially unbonded particulate refractory material. That Specification also describes a tundish lining system having means which, when the tundish is filled with molten metal, cause heat loss from the metal to be greater in the area where the molten metal enters the tundish, the so-called impact area, than in the area or areas from which the molten metal is withdrawn. Such a lining system can include the use of slabs of heat conductive material e.g. a bonded silicon carbide/graphite mixture placed between the slabs of expendable lining and the permanent lining near the impact area.

It has now been discovered that the life of the material protecting the impact area of the tundish can be improved and other advantages are obtained if a body of highly heat conductive material is located below the material protecting the impact area.

According to the invention, a tundish comprises an outer metal casing, a permanent refractory lining adjacent the casing and an inner expendable lining made up of a set of slabs of heat-insulating material, the impact area of the tundish being protected by highly erosion resistant or sacrificial material, and a body of refractory highly heat conductive material located below the material protecting the impact area.

Most preferably the body is set into a suitably located recess in the permanent lining in the base of the tundish so that the material protecting the impact area may be level with the adjacent slabs of the expendable lining. Most preferably the body is in the form of a block which is set into the recess by means of a refractory mortar.

The body of refractory highly heat conductive material may comprise for example graphite and/or silicon carbide together with other refractory materials such as alumina or silica. A body comprising a mixture of graphite, alumina, silica and silicon carbide is preferred. The body also contains a binder such as a clay, phosphate or aluminate or the body may be bonded by a carbon bond produced during manufacture of the body from a material such as pitch.

Such a body has a high heat conductivity relative to normal refractories such as refractory brick and refractory concretes and is thus readily able to dissipate heat away from the erosion resistant or sacrificial material into the refractory material of the permanent lining. Preferred bodies of the types just noted have a thermal conductivity of 5 - 40 Kcal/m hr° C. The highly heat conductive body also acts as a safety device; if molten metal penetrates the erosion resistant or sacrificial material, the highly heat conductive body takes the impact of the molten metal, not the relatively permanent lining.

The use of so-called "anisotropic" heat conductive bodies is particularly advantageous since in use it is possible to locate the body such that its thermal conductivity in a direction parallel with the base of the tundish is greater than in a direction perpendicular to the base. This means that more heat can be dissipated from the body along the length of the permanent refractory lining compared with the amount of heat dissipated through the thickness of the body which has the consequence of minimising heat passed to the outer metal casing. As a result the outer metal casing has greater protection and is kept relatively cool, e.g. less than 100° C.

The thickness of the block may vary but a thickness of 100 - 150 mm is usually sufficient.

If desired, in order to enhance the heat dissipation away from the impact area yet further, slabs of refractory highly heat-conductive material may be located between the expendable lining slabs on the walls of the tundish near the impact area and the relatively permanent refractory lining on those walls.

Figure 2:
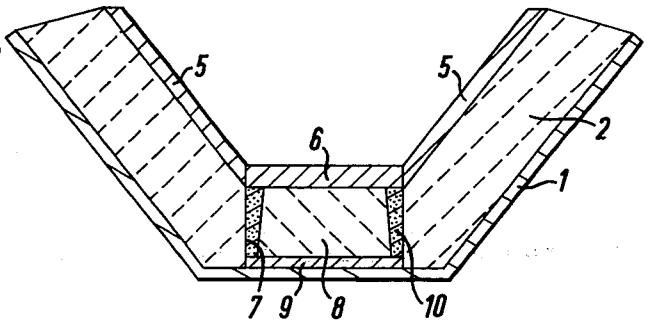
Figure 3:
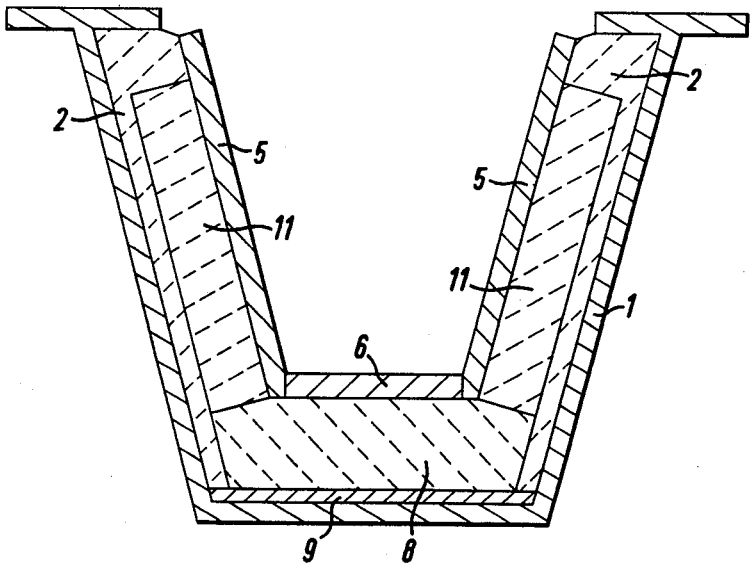

Embodiments of the invention are shown by way of Example in the accompanying diagrammatic drawings, in which FIG. 1 is a longitudinal sectional view of a tundish, FIG. 2 is a transverse sectional view taken along lines II — II of FIG. 1, and FIG. 3 is a view similar to FIG. 2 of an alternative.

Referring first to FIGS. 1 and 2 the tundish comprises a metal casing 1 which has an internal permanent lining 2 of a cast monolithic refractory concrete. The floor 3 of the lining has two outlet nozzles 3. The inner surface of the lining 2 is lined with an expendable lining 4 formed of a set of slabs 5 dimensioned and shaped to fit together. The impact area of the floor, on to which a stream of molten metal impinges, is protected by a pad 6 formed of steel, refractory concrete or material similar to that used for the expendable lining, e.g. a calcined magnesite based material containing a small amount of fibre and having a density of about 1.6 g/cm$^3$. Below the pad 6 is a recess 7 into which is fitted a block 8 of a refractory material which has high heat conductivity e.g. a silicon carbide-graphite block. The block 8 is located on a layer of refractory bricks or an asbestos sheet 9, and is tapered as shown, and is keyed into the recess by refractory mortar 10.

In use in continuous casting steel is poured into the tundish in a continuous stream. The stream of steel impinges on the pad 6 and then exits from the tundish via the nozzles 3. The pad is gradually eroded by the molten metal and must be replaced between casting cycles. The presence of the block 8 formed of a material having a high heat conductivity conducts heat away from the pad 6 into the permanent layer 2, so tending to prolong its useful life, and that of the metal casing.

The presence of the expendable lining 4 tends to protect the permanent lining 2 and generally confers the other advantages listed in British patent specification No. 1,364,655.

In the arrangement shown in FIG. 3, the advantages just noted are further enhanced by the presence of additional blocks 11 of material of high heat conductivity. Blocks 11 are of the same material as block 8 and are fitted thereto as shown. Using the arrangement of FIG. 3, heat is conducted away from the impact area not only through the floor in that area but also through the walls.

I claim:

1. In a tundish comprising an outer metal casing, a permanent refractory lining adjacent the casing, and an inner expendable lining made up of a set of slabs of heat insulating material, the impact area of the tundish being protected by a material selected from the class consisting of highly erosion resistant materials and sacrificial materials, the improvement which comprises providing a body of refractory highly heat-conductive material set in a recess in the permanent lining in the base of the tundish, and located below the material protecting the impact area to conduct heat away therefrom.

2. The tundish of claim 1 wherein the body is set in the recess by refractory mortar.

3. The tundish of claim 1 wherein the body is formed of a composition comprising graphite, alumina, silica and silicon carbide and a binding agent.

4. The tundish of claim 1 wherein the thermal conductivity of the highly heat-conductive refractory body is greater in directions parallel to the plane of the floor of the tundish than in the direction perpendicular thereto.

5. The tundish of claim 1 wherein the refractory highly heat conductive body is a block 100 to 150 mm thick.

6. The tundish of claim 1 and including at least one slab of refractory highly heat conductive material located between the permanent lining and the expendable lining adjacent the impact area of the tundish.

* * * * *